US010518557B2

(12) United States Patent
Okada

(10) Patent No.: US 10,518,557 B2
(45) Date of Patent: Dec. 31, 2019

(54) DRYING APPARATUS, RECORDING APPARATUS, AND DRYING METHOD

(71) Applicant: SEIKO EPSON CORPORATION, Tokyo (JP)

(72) Inventor: Hideki Okada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,184

(22) Filed: Mar. 6, 2018

(65) Prior Publication Data

US 2018/0257399 A1 Sep. 13, 2018

(30) Foreign Application Priority Data

Mar. 8, 2017 (JP) ..... 2017-043552

(51) Int. Cl.

| | |
|---|---|
| ***B41J 11/00*** | (2006.01) |
| ***F26B 5/04*** | (2006.01) |
| ***B41J 3/407*** | (2006.01) |
| ***B41M 7/00*** | (2006.01) |
| *B41M 5/00* | (2006.01) |

(52) U.S. Cl.

CPC ..... *B41J 11/002* (2013.01); *B41J 3/4073* (2013.01); *B41M 7/009* (2013.01); *F26B 5/047* (2013.01); *B41M 5/0064* (2013.01); *B41M 5/0088* (2013.01)

(58) Field of Classification Search

CPC ..... B41J 3/4073; B41J 11/002; B41M 7/009; F26B 5/047

See application file for complete search history.

(56) References Cited

FOREIGN PATENT DOCUMENTS

| | | | |
|---|---|---|---|
| JP | 60-026635 | Y2 | 10/1985 |
| JP | 06-221754 | A | 8/1994 |
| JP | 06-229669 | A | 8/1994 |
| JP | 07-286775 | A | 10/1995 |

*Primary Examiner* — Lamson D Nguyen

(74) *Attorney, Agent, or Firm* — Workman Nydegger

(57) ABSTRACT

A drying apparatus includes a drying chamber configured to be connected to a decompression section, and a moving section configured to move a target object in the interior of the drying chamber. With this structure, the pressure in the interior of the drying chamber can be reduced and the target object can be dried in the interior of the drying chamber, and thereby the drying efficiency of the target object can be increased.

13 Claims, 5 Drawing Sheets

DRYING APPARATUS, RECORDING APPARATUS, AND DRYING METHOD

BACKGROUND

1. Technical Field

The present invention relates a drying apparatus, a recording apparatus, and a drying method.

2. Related Art

Various drying apparatuses are used. Some of the drying apparatuses dry objects under reduced pressure in a drying chamber. This is because the target objects can be dried more efficiently in the pressure-reduced drying chamber than in a drying chamber in an atmospheric pressure state. For example, JP-A-6-229669 discloses a decompression drying apparatus that dries target objects under reduced pressure in a decompression drying chamber having a drying heater.

The decompression drying apparatus disclosed in JP-A-6-229669 supplies a heated gas into the decompression drying chamber. In such a structure, however, the target object does not always efficiently contact the airflow (the airflow does not evenly contact the object to be dried), and the portions where the target object and the airflow are not effectively in contact with each other are not sufficiently dried. To cope with the problem, in the structure for drying target objects in a decompression drying chamber, the demand for increasing efficiency in drying target objects has been increasing.

SUMMARY

An advantage of some aspects of the invention is that there is provided a drying apparatus for drying a target object in a decompression drying chamber with an increased efficiency in drying target objects.

A drying apparatus according to a first aspect of the invention includes a drying chamber configured to be connected to a decompression section, and a moving section configured to move a target object in the interior of the drying chamber.

With this structure, the pressure in the interior of a drying chamber can be reduced by a decompression section and a target object can be moved in the interior of the drying chamber, and thereby an airflow generated by the movement of the target object can be effectively brought into contact with the target object. Consequently, the drying efficiency of the target object can be increased. The expression "dry a target object" means, in a narrow sense, to dry (volatile) a target liquid component that a user intends to dry contained in the target object.

It is preferable that the drying apparatus include an airflow generation section configured to generate an airflow into the interior.

In this structure, an airflow generation section configured to generate an airflow into the interior of the drying chamber is provided, and thereby the airflow can be effectively bought into contact with the target object.

In this drying apparatus, it is preferable that the drying chamber include a radiation heating section.

In this drying apparatus, the drying chamber includes a radiation heating section, and the radiation heating section heats the interior of the drying chamber, increasing the drying efficiency of the target object.

In this drying apparatus, it is preferable that the drying chamber include a gas introduction section configured to introduce a gas into the interior.

In this structure, the drying chamber includes a gas introduction section configured to introduce a gas into the interior. Accordingly, an airflow can be generated by the gas introduction section and the airflow can be effectively brought into contact with the target object.

In this drying apparatus, it is preferable that the gas introduction section be configured to introduce a heated gas.

With this structure, the gas introduction section can introduce a heated gas. Accordingly, an airflow can be generated by using the heated gas by the gas introduction section and the airflow can be effectively brought into contact with the target object.

In this drying apparatus, it is preferable that the gas introduction section be configured to introduce a dried gas.

With this structure, the gas introduction section can introduce a dried gas. Accordingly, an airflow can be generated by using the dried gas by the gas introduction section and the airflow can be effectively brought into contact with the target object.

In this drying apparatus, it is preferable that the moving section be configured to support a holding section configured to hold the target object.

In this structure, the moving section is configured to support a holding section configured to hold the target object. Accordingly, the target object can be moved in a state in which the target object is securely held by the holding section.

In this drying apparatus, it is preferable that the holding section be configured to hold a plurality of target objects.

In this structure, the holding section is configured to hold a plurality of target objects. Accordingly, the target objects can be moved in a state in which the target objects are securely held by the holding section.

In this drying apparatus, it is preferable that the moving section be configured to rotate the holding section.

In this structure, the moving section is configured to rotate the holding section. Accordingly, by rotating the holding section, an airflow can be effectively brought into contact with the target objects.

In this drying apparatus, it is preferable that the drying chamber include a holding section introduction section configured to introduce the holding section into the interior.

In this structure, the drying chamber includes a holding section introduction section configured to introduce the holding section into the interior. Accordingly, the drying chamber to be decompressed can be separated from the other components in the drying apparatus, and thereby only the interior of the drying chamber can be decompressed and the decompression control of the drying chamber can be performed simply.

In this drying apparatus, it is preferable that the drying apparatus include a decompression chamber adjacent to the drying chamber with the holding section introduction section therebetween, the decompression chamber being configured to be decompressed.

In this structure, the drying apparatus includes a decompression chamber adjacent to the drying chamber with the holding section introduction section therebetween, the decompression chamber being configured to be decompressed. In introducing the holding section into the interior of the drying chamber, the decompression chamber is decompressed and then the holding section in the decompression chamber is introduced into the interior of the drying chamber, and thereby change in the decompression levels due to air flowing into the decompressed drying chamber can be prevented.

In this drying apparatus, it is preferable that the drying chamber include a holding section ejection section configured to eject the holding section from the interior.

In this structure, the drying chamber includes a holding section ejection section configured to eject the holding section from the interior. Accordingly, the drying chamber to be decompressed can be separated from the other components in the drying apparatus, and thereby only the interior of the drying chamber can be decompressed and the decompression control of the drying chamber can be performed simply.

In this drying apparatus, it is preferable that the drying apparatus include a decompression restoration chamber adjacent to the drying chamber with the holding section ejection section therebetween, the decompression restoration chamber being configured to restore a decompressed state to an atmospheric pressure state.

In this structure, the drying apparatus includes a decompression restoration chamber adjacent to the drying chamber with the holding section ejection section therebetween, the decompression restoration chamber being configured to restore a decompressed state to an atmospheric pressure state. In ejecting the holding section from the interior of the drying chamber, the holding section is ejected from the interior of the drying chamber in a state the decompression restoration chamber has been decompressed and then the decompression restoration chamber is restored, and thereby change in the decompression levels due to air flowing into the decompressed drying chamber can be prevented.

In this drying apparatus, it is preferable that the moving section be configured to support a plurality of holding sections.

In this structure, the moving section is configured to support a plurality of holding sections, and the target objects can be effectively held.

According to a second aspect of the invention, a recording apparatus includes a recording head configured to discharge a liquid ink onto a target object, and the drying apparatus according to the first aspect.

With this structure, an ink discharged from a recording head onto a target object can be effectively dried.

According to a third aspect of the invention, a drying method includes decompressing the interior of a drying chamber, and moving a target object in the interior.

In this method, a target object can be moved in the interior of a drying chamber in the moving while the pressure in the interior of the drying chamber is reduced in the decompressing, and thereby an airflow generated by the movement of the target object can be effectively brought into contact with the target object. Consequently, the drying efficiency of the target object can be increased.

In this method, it is preferable that the moving include a first moving and a second moving to be performed after the first moving, and the moving speed of the target object in the first moving be lower than the moving speed of the target object in the second moving.

In this method, the moving includes a first moving in which the moving speed of the target object is low and a second moving in which the moving speed of the target object is high. In the initial stage of drying in which the liquid on the target object can easily move (drip), the target object can be dried under conditions the movement of the liquid is regulated, and in the latter stage of drying in which the liquid on the target object does not easily move, the target object can be dried under conditions for enhancing the drying.

It is preferable that the method include generating an airflow into the interior.

This method include generating an airflow into the interior and thereby the airflow can be effectively bought into contact with the target object.

In this method, it is preferable that the generating an airflow includes a first airflow generating and a second airflow generating to be performed after the first airflow generating, and the speed of the airflow in the first airflow generating is lower than the speed of the airflow in the second airflow generating.

In this method, the generating an airflow includes a first airflow generating in which the speed of the airflow is low and the second airflow generating in which the speed of the airflow is high. In the initial stage of drying in which the liquid on a target object can easily move (drip), the target object can be dried under conditions the movement of the liquid is regulated, and in the latter stage of drying in which the liquid on the target object does not easily move, the target object can be dried under conditions for enhancing the drying.

In this method, it is preferable that the method include discharging a liquid ink onto the target object for recording, and the decompressing includes decompressing the interior in a state in which the target object that has been recorded in the recording is in the interior.

In this method, in the recording, the ink discharged onto the target object can be effectively dried.

In this method, it is preferable that the decompressing includes decompressing the interior within a range 0.1 times or more the atmospheric pressure and 0.5 times or less the atmospheric pressure.

In this method, the decompressing includes decompressing the interior within a range 0.1 times or more the atmospheric pressure and 0.5 times or less the atmospheric pressure. Accordingly, the target object can be dried under an appropriate pressure-reduced environment.

It is preferable that the method include heating the interior.

This method includes heating the interior, and by heating the interior of the drying chamber, the drying efficiency of the target object can be increased.

In this method, it is preferable that the target object be a thermoplastic object, and the heating include heating the interior within a range less than the deflection temperature under load of the target object.

In this method, the interior of the drying chamber is heated within a range less than the deflection temperature under load of a thermoplastic target object. Accordingly, the target object can be dried while the deformation of the target object is prevented.

In this method, it is preferable that the target object be a three-dimensional object, and the heating include heating the interior within a temperature range the three-dimensional object is not deformed.

Although the three-dimensional object is easily deformed by heat, according to this method, the three-dimensional object can be dried while the deformation of the three-dimensional object is prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a drying apparatus according to a first embodiment of the invention will be described with reference to the attached drawings.

Figure 1:
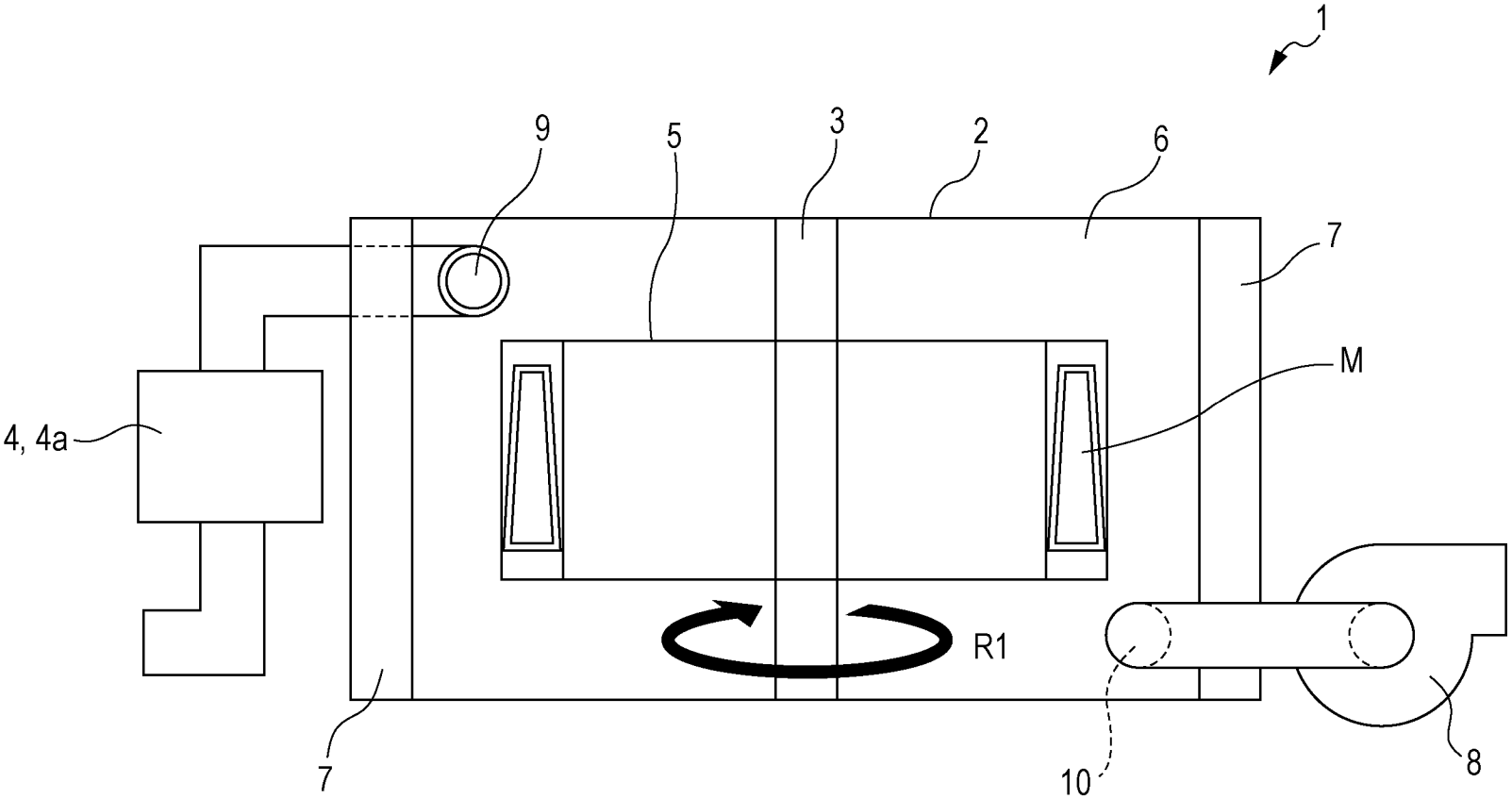
FIG. 1 is a schematic front view of a drying apparatus according to a first embodiment of the invention.
Figure 2:
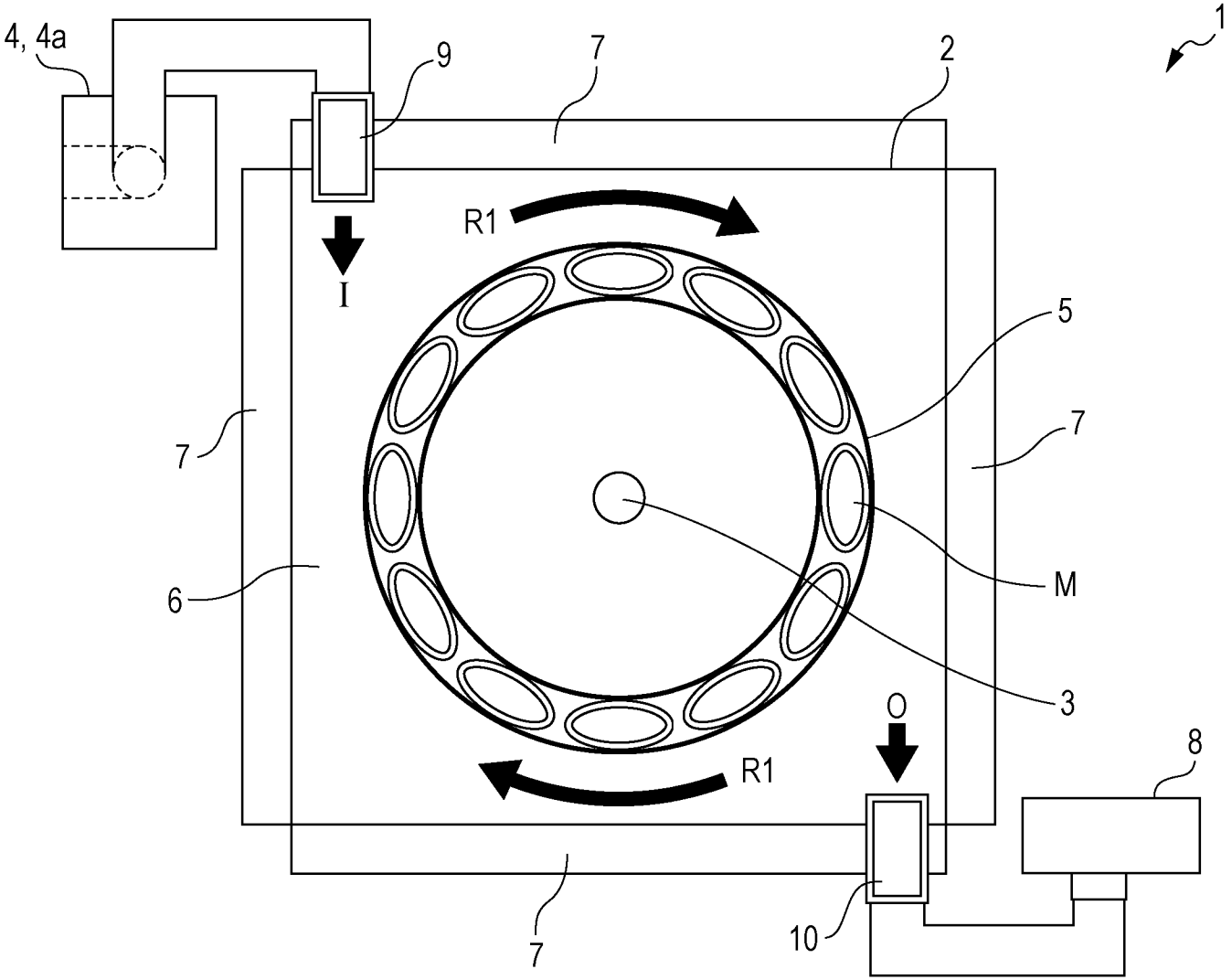
FIG. 2 is a schematic plan view of the drying apparatus according to the first embodiment of the invention.
Figure 3:
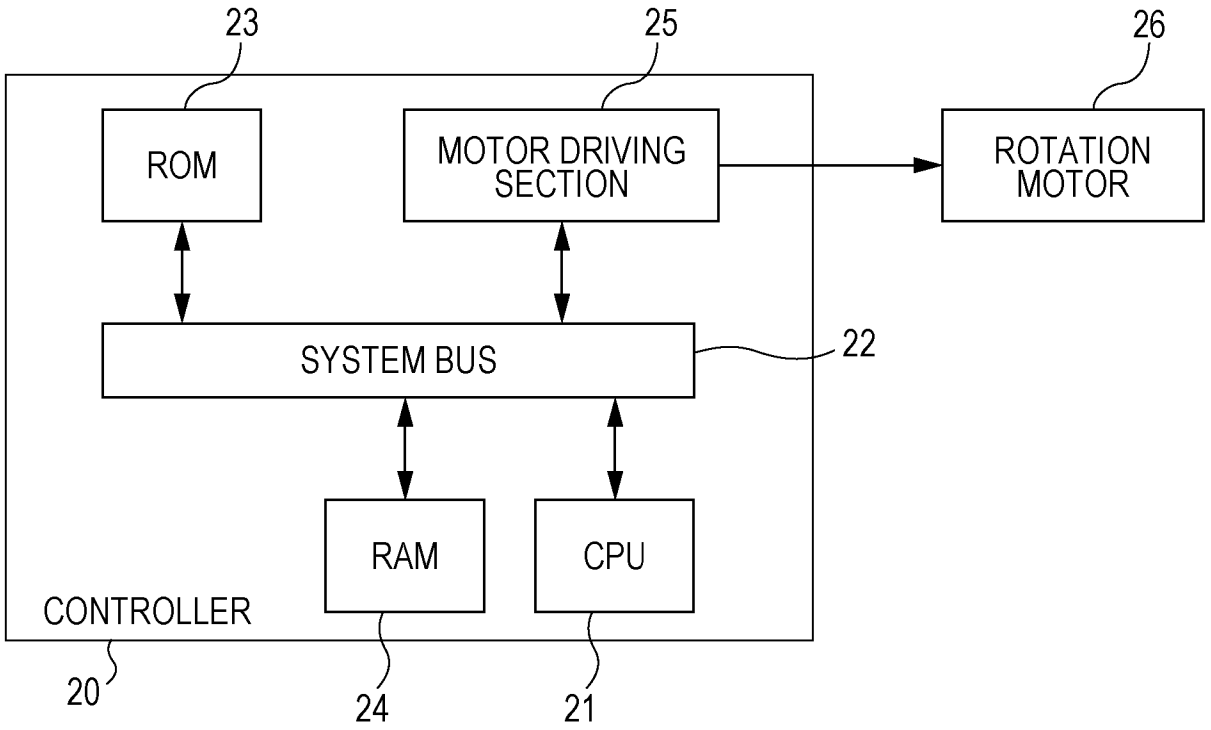
FIG. 3 is a block diagram of the drying apparatus according to the first embodiment of the invention.

First Embodiment (FIG. 1 to FIG. 3)

First, an overview of a drying apparatus 1 according to the first embodiment of the invention will be described. FIG. 1 is a schematic front view of the drying apparatus 1 according to the embodiment. FIG. 2 is a schematic plan view of the drying apparatus 1 according to the embodiment.

The drying apparatus 1 according to the embodiment is a drying apparatus that can dry (specifically, volatilize a volatile component) an ink on a three-dimensional thermoplastic target object M, for example, a plastic bottle, on which an image is formed using a liquid ink such as a water-based ink containing water and an organic solvent as a volatile solvent. It should be noted that the drying apparatus is not limited to the drying apparatus for drying such a target object M. The expression "dry a target object M" means, in a narrow sense, to dry (to volatile a volatile component) a target liquid component that a user intends to dry contained in a target object M.

As illustrated in FIG. 1 and FIG. 2, the drying apparatus 1 according to the embodiment includes a drying chamber 2 and a rotation stage 5 that is provided in an interior 6 of the drying chamber 2 and serves as a holding section for holding a target object M. The drying apparatus 1 according to the embodiment can be connected to a decompression section 8 via an outlet 10 to reduce the pressure in the interior 6 of the drying chamber 2 (to discharge the air in the interior 6 of the drying chamber 2 in a direction O) by the decompression section 8. The drying apparatus 1 according to the embodiment can also be connected to an airflow heating section 4*a* that serves as an airflow generation section 4 that can provide a flow of heated air into the interior 6 of the drying chamber 2 via an inlet 9 (provide heated air into the interior 6 of the drying chamber 2 in a direction I). In FIG. 1 and FIG. 2, the drying apparatus 1 is connected to both the decompression section 8 and the airflow generation section 4, and, in the drying apparatus 1 according to the embodiment, the decompression section 8 and the airflow generation section 4 can be considered as a part of the drying apparatus 1 or the decompression section 8 and the airflow generation section 4 can be considered as components separated from the drying apparatus 1. If a supply source of a vacuum or compressed air is available at the location the drying apparatus 1 is installed, by connecting the drying apparatus 1 to use the supply source of a vacuum or compressed air via the outlet 10 or the inlet 9, the pressure in the interior 6 of the drying chamber 2 can be reduced or an airflow can be generated in the interior 6 of the drying chamber 2.

The drying apparatus 1 according to the embodiment includes a radiation heating section 7 on a wall section of the drying chamber 2 (on the side of the interior 6 of the drying chamber 2, strictly). The radiation heating section 7 can heat the interior 6 of the drying chamber 2 by radiation. In FIG. 2, the drying apparatus 1 has four radiation heating sections 7 that are provided on respective four wall sections, which are side walls of the substantially square drying chamber 2 in plan view.

The rotation stage 5 can be rotated in a rotation direction R1 about a rotation shaft 3 that is connected to a rotation motor 26 (see FIG. 3). In other words, the rotation motor 26 serves as a moving section that moves a target object M in the interior 6 of the drying chamber 2.

As described above, the drying apparatus 1 according to the embodiment includes the drying chamber 2, which can be connected to the decompression section 8, and the rotation motor 26, which serves as the moving section that moves a target object M in the interior 6 of the drying chamber 2. With this structure, the drying apparatus 1 according to the embodiment can move a target object M in the interior 6 of the drying chamber 2 while reducing the pressure in the interior 6 of the drying chamber 2 by the decompression section 8, and thereby the airflow generated by the movement of the target object M can be effectively brought into contact with the target object M. Consequently, the drying apparatus 1 according to the embodiment operates with the increased efficiency in drying a target object M. Such an effect can be achieved because, although the density of the volatilized components around the target object M during the drying increases as the target object M is dried, the volatilized components, especially around the target object M, can be moved from the area by moving the target object M.

It is preferable that a target object M on which an image has been formed using a liquid ink be dried step by step. If an amount of a solvent and other components contained in the liquid ink that has adhered to the target object M exceeds a predetermined value, the liquid ink that has adhered to the target object M can move and the formed image may be distorted by moving the target object M to which the liquid ink has adhered or by bringing an airflow into contact with the adhered liquid ink. To solve the problem, it is preferable that the target object M be moved at a low speed and the speed of the airflow to be brought into contact with the liquid ink that has adhered to the target object M be low, and the speed of the airflow relative to the target object M be, for example, 5 m/s or less. In another case, if the heating temperature is too high, volatile components of a solvent and other components contained in the liquid ink that has adhered to the target object M can boil and bubbles of the vaporized solvent and other components in the adhered liquid may be produced, and thereby the formed image may be distorted. To solve the problem, in heating, it is preferable that the temperature be regulated to a temperature lower than a lowest boiling point of the components contained in the liquid ink. Furthermore, if the drying of the liquid ink that has adhered to the target object M is performed rapidly, the evaporation of the solvent and other components may cause a sharp volumetric shrinkage of the formed image and these voids and uneven shrinkage may cause a quality problem. Consequently, until the ratio of the solvent and other components contained in the liquid ink that has adhered to the target object M falls a predetermined value or less, it is preferable that an evaporation rate of the solvent and other components per unit time be regulated and the drying speed be low.

As the evaporation of the solvent and other components contained in the liquid ink that has adhered to the target object M proceeds, the ratio of the solvent and other components contained in the liquid ink that has adhered to the target object M decreases to a predetermined value or less, and then, even if the target object M is moved or the liquid ink is brought into contact with an airflow, the liquid ink that has adhered to the target object M will not move and accordingly, the formed image will not be distorted. Consequently, it is preferable that the target object M be moved at a high speed and the speed of the airflow to be brought into contact with the liquid ink that has adhered to the target object M be increased to enhance the drying, and the speed of the airflow relative to the target object M be, for example, 20 m/s or more. In another case, when the heating temperature is increased to high temperatures, if the remaining amount of the solvent and other components contained in the liquid ink is less than or equal to a predetermined value, no bubbles will probably be produced due to boiling or other factors and the formed image will not be distorted. Consequently, in heating, the temperature can be maintained at a temperature higher than a highest boiling point of the components contained in the liquid ink to enhance the drying. Furthermore, even if the drying of the liquid ink that has adhered to the target object M is performed rapidly, the amount of the solvent and other components to vaporize is less than or equal to a predetermined value, and a sharp volumetric shrinkage of the formed image will not occur, and accordingly, a quality problem due to voids and uneven shrinkage will not occur. Consequently, the evaporation of the solvent and other components contained in the liquid ink that has adhered to the target object M can be enhanced and the drying speed can be increased.

In other words, in a first step in which the amount of the solvent contained in the liquid ink that has adhered to the target object M is larger than a predetermined value, in the drying process in the first step, the liquid ink that has adhered to the target object M moves easily. Accordingly, it is preferable that the speed of the airflow relative to the target object M be low, the heating temperature be low to suppress the generation of bubbles from the liquid ink that has adhered to the target object M, and the drying speed be low to prevent sharp volumetric shrinkage of the formed image. In a second step in which the amount of the solvent contained in the liquid ink that has adhered to the target object M is less than or equal to the predetermined value, in the drying process in the second step, the speed of the airflow relative to the target object M may be high, the heating temperature may be high, and the drying speed may be high. Alternatively, the first step may be a state in which an amount of a solvent that increases the flowability of the liquid ink is large, and the second step may be a state in which an amount of a solvent that dissolve or disperse components contained in the liquid ink that solidifies in image formation is large. By performing the drying process step by step through the drying process in the first step and the drying process in the second step, the quality in strength of the coating of the image formed with the liquid ink that has adhered to the target object M can be increased.

Next, an electric configuration in the drying apparatus 1 according to the embodiment will be described. FIG. 3 is a block diagram of the drying apparatus 1 according to the embodiment. A controller 20 includes a central processing unit (CPU) 21 that performs overall control of the drying apparatus 1. The CPU 21 is connected to a read-only memory (ROM) 23 that stores various control programs to be executed by the CPU 21 and a random access memory (RAM) 24 that can temporarily store data via a system bus 22. The CPU 21 is also connected to the motor driving section 25 for driving the rotation motor 26 via the system bus 22.

In the drying apparatus 1 according to the embodiment, the controller 20 is instructed to perform overall control of the drying apparatus 1 and thereby a drying method that includes a decompressing step of reducing the pressure in the interior 6 of the drying chamber 2 and a moving step of moving a target object M in the interior 6 of the drying chamber 2 can be performed. By performing this method, the target object M can be moved in the interior 6 of the drying chamber 2 while the pressure in the interior 6 of the drying chamber 2 is reduced in the decompressing step, and thereby the airflow generated by the movement of the target object M can be effectively brought into contact with the target object M. Consequently, the drying efficiency of the target object M can be increased.

It is preferable that, in the decompressing step, the pressure in the interior 6 of the drying chamber 2 be reduced within a range 0.1 times or more the atmospheric pressure and 0.5 times or less the atmospheric pressure. By reducing the pressure in the interior 6 of the drying chamber 2 within the range of 0.1 times or more the atmospheric pressure and 0.5 times or less the atmospheric pressure, the target object M can be dried under an appropriate pressure-reduced environment.

In the drying apparatus 1 according to the embodiment, under the control of the controller 20, the moving step may be divided into a first moving step and a second moving step that is performed after the first moving step, and the moving speed of a target object M may be lower than the moving speed of the target object M in the second moving step. By dividing the moving step into the first moving step in which the moving speed of the target object M is low and the second moving step in which the moving speed of the target object M is high, in the initial stage of drying in which the liquid (for example, an ink) on the target object M can easily move (drip), the target object M can be dried under conditions the movement of the liquid is regulated, and in the latter stage of drying in which the liquid on the target object M does not easily move, the target object M can be dried under conditions for enhancing the drying.

As illustrated in FIG. 1 and FIG. 2, the drying apparatus 1 according to the embodiment includes the airflow generation section 4 (airflow heating section 4*a*) that generates an airflow into the interior 6 of the drying chamber 2. With this structure, the drying apparatus 1 according to the embodiment can effectively bring the airflow into contact with a target object M.

In another expression, by using the drying apparatus 1 according to the embodiment, the drying method that includes an airflow generating step for generating an airflow in the interior 6 of the drying chamber 2 can be performed. By performing the drying method, an airflow can be effectively brought into contact with a target object M. It is preferable that the direction of airflow generation be a direction in which a laminar flow of air can be blown on the target object M. The direction is not limited to the direction, however.

In the drying apparatus 1 according to the embodiment, under the control of the controller 20, the airflow generating step may be divided into a first airflow generating step and a second airflow generating step that is performed after the first airflow generating step, and the speed of the airflow in the first airflow generating step may be lower than the speed of the airflow in the second airflow generating step. By dividing the airflow generating step into the first airflow generating step in which the speed of the airflow is low and the second airflow generating step in which the speed of the airflow is high, in the initial stage of drying in which the liquid (for example, an ink) on a target object M can easily move (drip), the target object M can be dried under conditions the movement of the liquid is regulated, and in the latter stage of drying in which the liquid on the target object M does not easily move, the target object M can be dried under conditions for enhancing the drying.

As illustrated in FIG. 1 and FIG. 2, the drying apparatus 1 according to the embodiment includes the radiation heating sections 7 that are provided on the drying chamber 2 and can heat the interior 6 of the drying chamber 2 by radiation. With this structure, the drying apparatus 1 according to the embodiment can heat the interior 6 by using the radiation heating sections 7, thus the drying efficiency of a target object M can be increased.

As illustrated in FIG. 1 and FIG. 2, the drying apparatus 1 according to the embodiment includes, in the drying chamber 2, the inlet 9 that serves as a gas introduction section that can introduce a gas into the the interior 6. With this structure, the drying apparatus 1 according to the embodiment can generate an airflow by the inlet 9 and effectively bring the airflow into contact with a target object M.

The airflow heating section 4*a* with which the inlet 9 is connected heats air and the heated air is sent to the inlet 9. Accordingly, the inlet 9 in the drying apparatus 1 according to the embodiment can introduce a heated gas. With this structure, the drying apparatus 1 according to the embodiment can generate a flow of a heated gas by the inlet 9 and effectively bring the flow into contact with a target object M.

In another expression, by using the drying apparatus 1 according to the embodiment, the drying method that includes a heating step for heating the interior 6 of the drying chamber 2 can be performed. By performing the drying method to heat the interior 6 of the drying chamber 2, the drying efficiency of a target object M can be increased.

In the drying apparatus 1 according to the embodiment, the heating step may be divided into a first heating step and a second heating step that is performed after the first heating step, and the heating temperature in the first heating step may be lower than the heating temperature in the second heating step. By dividing the heating step into the first heating step in which the heating temperature is low and the second heating step in which the heating temperature is high, in the initial stage of drying in which the liquid (for example, a solvent that has a relatively low boiling point such as water in a water-based ink) on a target object M can easily boil (generate bubbles), the target object M can be dried under conditions the boil of the liquid is regulated, and in the latter stage of drying in which the liquid (for example, a solvent that has a relatively high boiling point that remains after the solvent having the relatively low boiling point such as water in the water-based ink has evaporated) on the target object M does not easily boil, the target object M can be dried under conditions for enhancing the drying. If a liquid on a target object M boils and produces bubbles, an image formed by an ink or the like may be distorted or the level of contact of the ink to the target object M may decrease. However, by dividing the heating step into the first heating step in which the heating temperature is low and the second heating step in which the heating temperature is high, such problems can be suppressed.

The airflow heating section 4*a* to which the inlet 9 is connected heats and dries air. Accordingly, the inlet 9 in the drying apparatus 1 according to the embodiment can introduce a dried gas. With this structure, the drying apparatus 1 according to the embodiment can generate a flow of a dried gas by the inlet 9 and effectively bring the flow into contact with a target object M.

As described above, the drying apparatus 1 according to the embodiment can be used to dry a thermoplastic bottle as a target object M. In other words, by using the drying apparatus 1 according to the embodiment, under the control of the controller 20, in the heating step, the interior 6 of the drying chamber 2 can be heated within a range less than the deflection temperature under load of the thermoplastic target object M. Accordingly, the target object M can be dried while the deformation of the target object M is prevented.

In another expression, the drying apparatus 1 according to the embodiment can be used to dry a three-dimensional plastic bottle as a target object M. By using the drying apparatus 1 according to the embodiment, under the control of the controller 20, in the heating step, the interior 6 of the drying chamber 2 can be heated within a temperature range the deformation of the three-dimensional bottle is prevented. Accordingly, the three-dimensional target object M can be dried while the deformation of the target object M is prevented. In the heating step, the temperature can be adjusted, specifically, by adjusting the heating temperature of the radiation heating section 7, by adjusting the heating temperature of the airflow in the airflow heating section 4*a*, or the like.

The rotation shaft 3 in the rotation stage 5, which is the holding section, in FIG. 1 and FIG. 2 is connected to the rotation motor 26 in FIG. 3, which is the moving section. In other words, the rotation motor 26, which serves as the moving section, in the drying apparatus 1 according to the embodiment can support the rotation stage 5, which is the holding section, that holds the target object M. With this structure, the drying apparatus 1 according to the embodiment can move a target object M while securely holding the target object M by the rotation stage 5.

As illustrated in FIG. 2, the rotation stage 5 according to the embodiment can hold a plurality of target objects M. With this structure, the drying apparatus 1 according to the embodiment can move target objects M while securely and effectively holding the target objects M by the rotation stage 5.

In another expression, the rotation motor 26 according to the embodiment can rotate the rotation stage 5. With this structure, the drying apparatus 1 according to the embodiment can effectively bring an airflow into contact with the target objects M by rotating the rotation stage 5.

The drying apparatus 1 according to the embodiment includes, as the airflow generation section 4, only the airflow heating section 4*a* that is externally connected to the drying chamber 2. It should be noted that the structure is not limited to this example. Alternatively to the airflow heating section 4*a* or together with the airflow heating section 4*a*, the airflow generation section 4 may be provided in the interior 6 of the drying chamber 2.

Now, a second embodiment that is an example structure having the airflow generation section 4 in the interior 6 of the drying chamber 2 will be described in detail with reference to the attached drawings.

Figure 4:
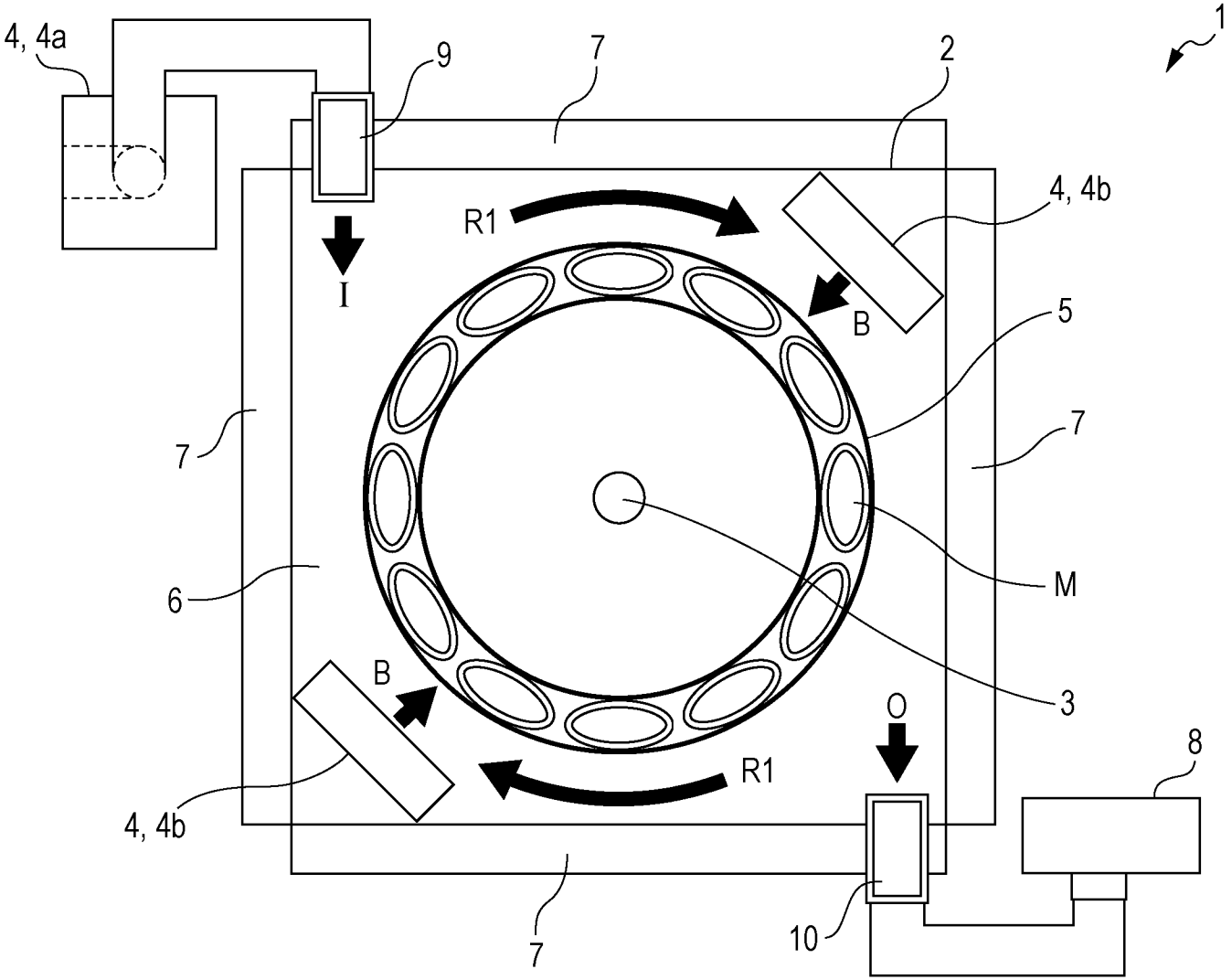
FIG. 4 is a schematic plan view of the drying apparatus according to a second embodiment of the invention.

Second Embodiment (FIG. 4)

FIG. 4 is a schematic front view of the drying apparatus 1 according the embodiment, and corresponds to FIG. 2 of the drying apparatus 1 according to the first embodiment. The same reference numerals are used to refer to the same or similar components in the above-described first embodiment, and detailed descriptions of the components are omitted. The drying apparatus 1 according to the embodiment has a structure similar to that of the drying apparatus 1 according to the first embodiment except that the drying apparatus 1 according to the embodiment includes the airflow generation sections 4 also in the interior 6 of the drying chamber 2.

As illustrated in FIG. 4, the drying apparatus 1 according to the embodiment includes blowing sections 4*b* as the airflow generation sections 4 in the interior 6 of the drying chamber 2. The blowing section 4*b* can blow air in a direction B which is a direction toward a target object M that is rotated and moved by rotating the rotation stage 5. In FIG. 4, the drying apparatus 1 includes two blowing sections 4*b* at corners opposite to each other so as to sandwich the rotation stage 5 in the substantially square drying chamber 2 in plan view. As in the drying apparatus 1 according to the embodiment, the airflow generation sections 4 provided in the interior 6 of the drying chamber 2 effectively bring the airflow to come into contact with target objects M.

Next, a recording apparatus 100 that includes a drying apparatus 1 according to a third embodiment, which is still another example structure, will be described in detail with reference to the attached drawings.

Figure 5:
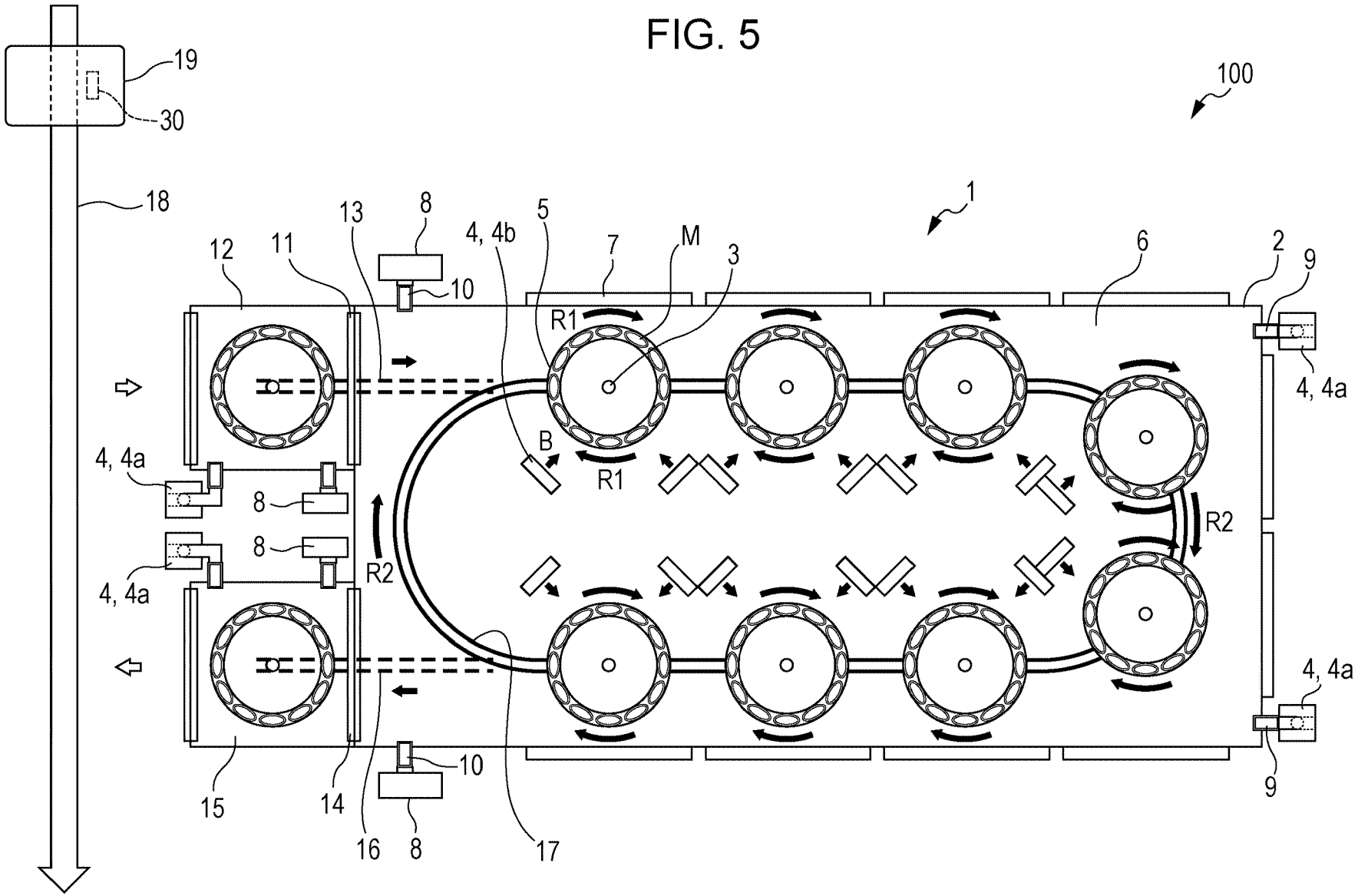
FIG. 5 is a schematic plan view of a recording apparatus that includes a drying apparatus according to a third embodiment of the invention.

Third Embodiment 3 (FIG. 5)

FIG. 5 is a schematic plan view of the drying apparatus 1 according to the embodiment and the recording apparatus 100 that includes the drying apparatus 1. The same reference numerals are used to refer to the same or similar components in the above-described first embodiment and the second embodiment, and detailed descriptions of the components are omitted.

As illustrated in FIG. 5, the recording apparatus 100 according to the embodiment includes the drying apparatus 1, which includes the drying chamber 2 that can accommodate a plurality of rotation stages 5, a transport path 18, which transports target objects M together with the rotation stage 5, and a recording section 19, which is provided on an upstream side of the drying apparatus 1 in the direction (arrow direction of the transport path 18 in the drawing) the rotation stage 5 is transported on the transport path 18.

The recording section 19 according to the embodiment includes a recording head 30 that can discharge a liquid ink onto a target object M. In other words, the recording apparatus 100 according to the embodiment includes the recording head 30, which can discharge a liquid ink onto a target object M, and the drying apparatus 1. With this structure, the drying apparatus 1 can effectively dry the ink discharged from the recording head 30 onto the target object M.

By using the recording apparatus 100 according to the embodiment, a drying method that includes a recording step of discharging a liquid ink onto a target object M for recording and a decompressing step of reducing the pressure in the interior 6 of the drying chamber 2 in a state the target object M on which the recording has been performed in the recording step by the decompression section 8, which will be described below, is in the interior 6 of the drying chamber 2, can be performed. By performing this drying method, the ink that has been discharged onto the target object M in the recording step can be effectively dried.

The target object M on which recording has been performed by the recording section 19 is moved together with the rotation stage 5 on the transport path 18 and dried by the drying apparatus 1. As illustrated in FIG. 5, the drying apparatus 1 according to the embodiment includes the drying chamber 2, and in the drying chamber 2, a plurality of rotation stages 5 can be moved in a direction R2 to circulate on a circulating rail 17. Furthermore, each of the rotation stages 5 is moved in the direction R2 while being rotated in the direction R1.

The drying chamber 2 in the drying apparatus 1 according to the embodiment can be connected to the decompression sections 8 via the outlets 10 and to the airflow heating sections 4*a* via the inlets 9 respectively, and has the radiation heating sections 7 similarly to the drying chambers 2 according to the first embodiment and the second embodiment. Furthermore, similarly to the drying chamber 2 according to the second embodiment, the blowing sections 4*b* are provided in the interior 6. The number of the outlets 10, the number of the inlets 9, the number of the radiation heating sections 7, and the number of the blowing sections 4*b* are respectively larger than those in the drying chambers 2 according the first and second embodiments to correspond to the size of the drying chamber 2. In other words, the drying apparatus 1 according to the embodiment has ten radiation heating sections 7 on three side walls of the substantially rectangular drying chamber 2 in plan view. The interior 6 of the drying chamber 2 includes 14 blowing sections 4*b*.

The drying apparatus 1 according to the embodiment has a decompression chamber 12 as a front chamber and a decompression restoration chamber 15 as a rear chamber between the transport path 18 and the drying chamber 2. Between the decompression chamber 12 and the drying chamber 2, a gate 11 is provided and between the decompression restoration chamber 15 and the drying chamber 2, a gate 14 is provided. The rotation stage 5 introduced from the transport path 18 into the decompression chamber 12 is moved on a rail 13 and moved onto the circulating rail 17 in the drying chamber 2. After the rotation stage 5 is circulated on the circulating rail 17 for a predetermined time, the rotation stage 5 is moved onto a rail 16 and moved into the decompression restoration chamber 15, and moved onto the transport path 18. The decompression chamber 12 and the decompression restoration chamber 15 have the decompression sections 8 and the airflow generation sections 4 (airflow heating sections 4*a*) respectively. The decompression chamber 12 and the decompression restoration chamber 15 can be decompressed and can be restored from a decompressed state.

The decompression chamber 12 and the decompression restoration chamber 15 may be configured to communicate with each other to use the exhaust from the decompression chamber 12 for the decompression restoration chamber 15. With this structure, the decompression chamber 12 and the decompression restoration chamber 15 can communicate with each other to synchronize the decompression in the decompression chamber 12 and the decompression restoration in the decompression restoration chamber 15 to exchange the pressures in the decompression chamber 12 and the decompression restoration chamber 15, and thereby energy losses due to the decompression and restoration can be reduced. The decompression chamber 12 and the decompression restoration chamber 15 may be a single common chamber in which decompression and decompression restoration can be performed.

In this embodiment, it is preferable that while a target object M passes through the decompression chamber 12, the drying chamber 2, and the decompression restoration chamber 15, the above-described drying process in the first step and the drying process in the second step be performed. For example, the drying process in the first step may be performed in the decompression chamber 12 and the drying process in the second step may be performed in the drying chamber 2 to perform the drying process at a low temperature and low speed in the decompression chamber 12 and perform the drying process at a high temperature and high speed in the drying chamber 2. Alternatively, while the rotation stage 5 is circulated on the circulating rail 17 in the drying chamber 2, after the rotation stage 5 has been introduced into the drying chamber 2, the drying process in the first step may be performed for a while and after a predetermined time has passed since the introduction, the rotation speed of the rotation stage 5 may be increased to perform the drying process in the second step.

In another expression, the drying chamber 2 of the drying apparatus 1 according to the embodiment includes the gate 11 as a holding section introduction section that can introduce the rotation stage 5 into the interior 6 of the drying chamber 2. With this structure, the drying apparatus 1 according to the embodiment can separate the drying chamber 2 for decompression from the other components in the drying apparatus 1. Accordingly, in the drying apparatus 1, only the interior 6 of the drying chamber 2 can be decompressed and thereby the decompression control of the drying chamber 2 can be performed simply.

The drying apparatus 1 according to the embodiment includes the decompression chamber 12 that is adjacent to the drying chamber 2 with the gate 11 therebetween and can be decompressed. With this structure, in the drying apparatus 1 according to the embodiment, in introducing the rotation stage 5 into the interior 6 of the drying chamber 2, the decompression chamber 12 is decompressed and then the rotation stage 5 in the decompression chamber 12 is introduced into the interior 6 of the drying chamber 2, and thereby change in the decompression levels due to air flowing into the decompressed drying chamber 2 can be prevented.

The drying chamber 2 of the drying apparatus 1 according to the embodiment includes the gate 14 as a holding section ejection section that can eject the rotation stage 5 from the interior 6 of the drying chamber 2. With this structure, the drying apparatus 1 according to the embodiment can separate the drying chamber 2 for decompression from the other components in the drying apparatus 1. Accordingly, in the drying apparatus 1, only the interior 6 of the drying chamber 2 can be decompressed and thereby the decompression control of the drying chamber 2 can be performed simply.

The drying apparatus 1 according to the embodiment includes the decompression restoration chamber 15 that is adjacent to the drying chamber 2 with the gate 14 therebetween and can restore a decompressed state to an atmospheric pressure state. With this structure, in the drying apparatus 1 according to the embodiment, in ejecting the rotation stage 5 from the interior 6 of the drying chamber 2, the rotation stage 5 is ejected from the interior 6 of the drying chamber 2 in a state the decompression restoration chamber 15 has been decompressed and then the decompression restoration chamber 15 is restored, and thereby change in the decompression levels due to air flowing into the decompressed drying chamber 2 can be prevented.

The drying apparatus 1 according to the embodiment includes a plurality of rotation motors 26 to correspond to the rotation stages 5 as the moving sections to support the rotation stages 5 via the rotation shafts 3. With this structure, the drying apparatus 1 according to the embodiment can effectively hold a plurality of target objects M.

It is to be understood that the invention is not limited to the above-described embodiments, various modifications can be made within the scope of the following claims, and these modifications are included within the scope of the invention.

This application claims priority under 35 U.S.C. § 119 to Japanese Patent Application No. 2017-043552, filed Mar. 8 2017. The entire disclosure of Japanese Patent Application No. 2017-043552 is hereby incorporated herein by reference.

What is claimed is:

1. A drying apparatus comprising:

a drying chamber configured to be connected to a decompression section; and a moving section configured to move one or more target objects in the interior of the drying chamber, wherein the moving section is confirmed to support a polarity of holding sections, each of which is configured to hold one of the one or more target objects.

2. The drying apparatus according to claim 1, further comprising:

an airflow generation section configured to generate an airflow into the interior.

3. The drying apparatus according to claim 1, wherein the drying chamber has a radiation heating section.

4. The drying apparatus according to claim 1, wherein the drying chamber includes a gas introduction section configured to introduce a gas into the interior.

5. The drying apparatus according to claim 4, wherein the gas introduction section is configured to introduce a heated gas.

6. The drying apparatus according to claim 4, wherein the gas introduction section is configured to introduce a dried gas.

7. The drying apparatus according to claim 1, wherein the holding section is configured to hold a plurality of target objects.

8. The drying apparatus according to claim 1, wherein the moving section is configured to rotate the holding section.

9. The drying apparatus according to claim 1, wherein the drying chamber includes a holding section introduction section configured to introduce the holding section into the interior.

10. The drying apparatus according to claim 9, further comprising:

a decompression chamber adjacent to the drying chamber with the holding section introduction section therebetween, the decompression chamber being configured to be decompressed.

11. The drying apparatus according to claim 1, wherein the drying chamber includes a holding section ejection section configured to eject the holding section from the interior.

12. The drying apparatus according to claim 11, further comprising:

a decompression restoration chamber adjacent to the drying chamber with the holding section ejection section therebetween, the decompression restoration chamber being configured to restore a decompressed state to an atmospheric pressure state.

13. A recording apparatus comprising:

a recording head configured to discharge a liquid ink onto a target object; and the drying apparatus according to claim 1.

* * * * *